United States Patent [19]

Maekawa

[11] 3,967,010

[45] June 29, 1976

[54] PROCESS FOR THE PRODUCTION OF METAL-PLATED STAPLE FIBERS

[75] Inventor: Minoru Maekawa, Okayama, Japan

[73] Assignee: Kuraray Co., Ltd., Okayama, Japan

[22] Filed: Nov. 11, 1974

[21] Appl. No.: 522,895

[30] Foreign Application Priority Data

Nov. 30, 1973 Japan ..... 48-135580

[52] U.S. Cl. ..... 427/306; 427/307; 427/308; 427/427; 428/361; 428/389

[51] Int. Cl.[2] ..... B05D 3/04; B05D 3/10

[58] Field of Search ..... 427/306, 307, 308, 427; 428/340, 361, 389, 394

[56] References Cited

UNITED STATES PATENTS

| | | | |
|---|---|---|---|
| 2,956,900 | 10/1960 | Carlson et al. | 427/306 |
| 2,956,901 | 10/1960 | Carlson et al. | 427/306 |
| 3,471,313 | 10/1969 | Saubestre et al. | 427/307 |
| 3,501,332 | 3/1970 | Buckman | 427/306 |
| 3,515,649 | 6/1970 | Hepter | 427/307 |
| 3,524,754 | 8/1970 | Blytas et al. | 427/306 |
| 3,617,343 | 11/1971 | Kandler et al. | 427/307 |
| 3,647,514 | 3/1972 | Ahlgrim et al. | 427/307 |
| 3,650,914 | 3/1972 | Lin | 427/307 |
| 3,671,291 | 6/1972 | Miller | 427/306 |
| 3,672,940 | 6/1972 | Funada et al. | 427/306 |

FOREIGN PATENTS OR APPLICATIONS

| | | | |
|---|---|---|---|
| 1,036,433 | 2/1963 | United Kingdom | 427/306 |
| 1,078,439 | 8/1967 | United Kingdom | 427/306 |

*Primary Examiner*—Harry J. Gwinnell
*Assistant Examiner*—Sadie L. Childs
*Attorney, Agent, or Firm*—Bierman & Bierman

[57] ABSTRACT

A process for the production of metal-plated staple fibers comprising providing staple fibers having an areal weight of 0.5 to 5.0 kg/m$^2$, activating said fibers by conventional means, and spraying an electroless metal-plating solution onto the activated fibers at a space velocity of 100 to 600m$^3$ of the plating solution per m$^3$ of the fibers per hour.

12 Claims, No Drawings

PROCESS FOR THE PRODUCTION OF METAL-PLATED STAPLE FIBERS

Detailed Description of Invention

This invention relates to a process for the production of metalplated staple fibers having a uniformly plated metal layer on the fiber surfaces.

In conventional methods of the electroless metal plating of fibers, fibers to be plated are subjected to the usual activation treatment and are dipped into an electroless metal plating solution. However, none of conventional methods have succeeded in preparing metal-plated staple fibers with high efficiency. We have determined that the cause of this is that distances between the individual fibers are very short in the fiber assembly to be plated and fine bubbles of hydrogen and other gases are generated from the fiber surfaces as the plating reaction advances. Therefore, penetration of the plating solution into the interior fiber of the assembly is inhibited. It was also found that, since in the case of fibers the surface area is much greater than in the case of molded articles of plastics having the same weight, the plating reaction advances very rapidly in the case of fibers and self-decomposition is caused in the plating solution, which inhibits successful performance of the plating operation.

Accordingly, we furthered our research to develop an economical process which overcomes the foregoing defects and provides metal-plated staple fibers having a uniform plating layer.

More specifically, in accordance with this invention, there is provided a process for the production of metal-plated staple fibers having a uniform plating layer by the electroless metal-plating method, which comprises providing staple fibers, which have been subjected to the activation treatment by a conventional method, having an areal weight of 0.5 to 5.0 kg/m$^2$, and spraying an electroless metal-plating solution onto the fibers at a space velocity of 100 to 600m$^3$ of the plating solution per m$^3$ of the fibers to be plated per hour.

Any synthetic fibers made by melt spinning, wet or dry spinning, as well as other chemical fibers may be plated in accordance with this invention. Thus polyesters, polyamides, polyolefins, polyacrylonitriles, acetates, rayons, and polyvinyl alcohol fibers as well as natural fibers such as cotton and wool are operable.

Further, we have found that the synthetic fibers obtained by wet or dry spinning are preferred over fibers obtained from melt spinning. However the plating layer on both fibers shows excellent adherence between the fiber and the plated metal as well as durability.

In view of the need for good adhesion between the fiber and the metal and required properties of plated fibers, it is preferred that the denier of monofilaments be from 0.1 to 15, especially from 1 to 6. In the case of fibers having a monofilament denier less than 0.1, good adhesion between the fiber and the metal, can be obtained, but when the metal is plated on the fiber in a thickness of about 1 $\mu$ or more, the inherent flexibility of fibers is completely lost. Further, the permeability of the plating solution is reduced and hence, it is impossible to obtain a uniform plating layer. On the other hand, in the case of fibers having a monofilament denier exceeding 15, the adherence between the fiber and metal is reduced because of the swelling and expansion of fibers brought about during the plating step and/or because of shrinkage of fibers caused during the drying or cooling step. Also, cracks are readily formed in the metal plating layer by mechanical deformation. Still further, plated fibers derived from fibers having a monofilament denier exceeding 15 exhibit only a very low antistatic effect. For these reasons, use of fibers having a monofilament denier outside the above range is not preferred.

To obtain the best combination of uniformity of the plating layer and facility in handling of fibers, it is preferred that the length of fibers be from 10 to 200mm, especially 20 to 150mm. When the fiber length is shorter than 10mm, the packing density is too high, and no uniform plating can be obtained. When the fiber length is longer than 200mm, handling difficulties are brought about in mix spinning of such fibers, though high uniformity of plating can be obtained.

The electroless plating process will now be illustrated.

The fibers, if necessary, are treated with warm water and a neutral detergent or the like to remove oils previously applied to the fiber surfaces; and the deoiled fibers, if necessary, are subjected to a known etching treatment depending on the kind of the fiber to be plated. For example, polyester fibers and polyacrylonitrile fibers are treated with an alkali metal hydroxide and polyolefin fibers and polyamide fibers are treated with a solution of the chromic anhydride-sulfuric acid type. Other fibers are treated with a suitable etching agent such as an alkaline substance, a chromic acid solution, etc. The fibers which have been thus subjected to the deoiling and/or etching treatment are subjected to the activation treatment according to customary procedures. The fibers must be activated prior to the treatment of the present invention. For example, a method comprising treating fibers with a hydrochloric acid-acidified aqueous solution of stannous chloride, washing the fibers with water, treating the fibers with a hydrochloric acid-acidified aqueous solution of palladium chloride and washing the fibers with water to remove unreacted palladium chloride from the fiber surfaces or from voids formed among the fibers can be adopted. In this invention, these pre-treatments may be conducted by a continuous shower method spraying a series of treating liquids, or batchwise by using an over maier dyeing machine.

After the foregoing pre-treatment, the electroless metal-plating is performed by using a plating solution containing nickel, copper, cobalt, chromium, tin or a mixture therefore (for example, nickel and cobalt). It has been found that a solution containing nickel as the metal is preferred, in view of such factors as the stability of the plating solution, the plating rate and the properties of plated fibers.

An important feature of this invention is that the electroless metal-plating is accomplished by projecting a plating solution onto staple fibers which have been subjected to activation. By virtue of this feature, penetration of the plating solution into the interior fibers of an assembly of staple fibers can be greatly facilitated and metal-plated fibers having a uniform plating layer can be obtained. In this step, it is preferred that fibers should be arranged in layer form on a wire net or perforated plate so that the areal weight is from 0.5 to 5.0 kg/m$^2$, preferably from 2.0 to 3.5 kg/m$^2$.

If the areal weight of the fibers in layer form is greater than 5.0 kg/m$^2$, the plating solution is prevented from penetrating into the interior fibers of the assembly and hence, uneven plating occurs. It is preferred that the metal-plating solution be sprayed uniformly on the upper portion of the fiber assembly from a spray cylinder having 25 to 100 holes per 100cm$^2$, each hole having a diameter of 2 to 5 mm. In this case, it is necessary that the plating solution be sprayed at a space velocity of 100 to 600m$^3$ of the plating solution per m$^3$ of the fibers to be plated per hour, and a space velocity ranging from 150 to 450 m$^3$ of the plating solution per m$^3$ of the fibers to be plated per hour is especially preferred.

When the space velocity is lower than 100 m$^3$ of the plating solution per m$^3$ of the fibers to be plated per hour, the packing density increase owing to prostration of the layer of fibers to be plated and penetration of the plating solution is reduced, resulting in uneven plating. When the space velocity is between 100 and 600 m$^3$ of the plating solution of m$^3$ per the fibers to be treated per hour, the fibers to be plated are expanded by gases such as hydrogen generated with the advance of the plating solution and an appropriate packing density can be obtained, so that the penetration of the plating solution into the interior fibers of the assembly is enhanced and metal-plated staple fibers having a uniform plating layer can be obtained without substantial uneven plating.

On the other hand, when the plating solution is sprayed at a space velocity exceeding 600 m$^3$ of the plating solution per m$^3$ of the fibers to be plated per hour, since the amount of the plating solution sprayed is too large, the plating solution overflows and the amount of metal plated is larger in the upper fibers of the assembly than in the middle and lower fibers. Further, the penetration of the plating solution into the assembly becomes uneven, resulting in uneven plating. Therefore, too high a space velocity is not preferred. Still further, when the plating reaction is abruptly accelerated, self-decomposition of the plating solution occurs and it becomes impossible to continue the plating operation.

The resulting metal-plated staple fibers, as they are, or after being mixed with unplated fibers, can be used in various fields as electric heater elements, carpets, electromagnetic shieldings, electricity removers of the self-discharge type and the like. Further, when they are incorporated in fibrous and plastic products in which static charges are readily generated and accumulated, an antistatic effect is obtained in these products.

The following Examples are illustrative of the invention:

EXAMPLE 1

1 Kg of polyacrylonitrile staple fibers having a denier of 3 and a fiber length of 57mm (abbreviated as "$3d \times 57m$" hereinafter) were subjected to the customary deoiling treatment to remove an oiling agent which had been applied to the fiber surfaces. The fibers were dipped at room temperature for 3 minutes in an aqueous solution containing 16g of stannous chloride and 20 ml of concentrated hydrochloric acid per liter of water, and the fibers were washed with water. Then, the fibers were dipped at room temperature for 3 minutes in an aqueous solution containing 0.3 g of palladium chloride and 3 ml of concentrated hydrochloric acid per liter of water, and they were washed with water. The so activated fibers were electrolessly metal-plated under the following conditions by spraying a metal-plating solution from a spraying cylinder having 30 spray holes per 100 cm$^2$ of surface, each hole having a diameter of 4 mm.

1. Composition of Nickel-Plating Solution:
   Nickel sulfate: 0.10 mole/l
   Sodium hypophosphite: 0.10 mole/l
   Sodium citrate: 0.10 mole/l
   Sodium acetate: 0.15 mole/l
2. Plating Conditions:
   Amount of plating solution: 200 l (circulated)
   Plating time: 30 minutes
   Plating temperature: 85°C.
   pH: 5.0
   Space velocity of plating solution: 50 – 700 m$^3$ of plating solution/m$^3$ of fibers to be plated/hour
   Amount packed of fiber assembly: fibers were uniformly dispersed on 10-mesh stainless steel net so that the areal weight of the fibers was 0.5 to 6 Kg/m$^3$ For comparison, polyacrylonitrile staple fibers which have been deoiled and activated under the same conditions as above were plated by dipping them at 85°C. for 30 minutes in 2001 of a metal-plating solution having the same composition as above.

This thickness of the plating layer on the surface of the so obtained metal-plated staple fibers was determined according to the weight and microscope methods to obtain results shown in Table 1.

Table 1

| Space Velocity of Plating Solution (m$^3$ of plating solution/m$^3$ of fibers to be plated/hour) | Packed Amount (Kg/m$^2$) | Plating Thickness ($\mu$) in Upper Portion of Fiber Assembly | Plating Thickness ($\mu$) in Lower Portion of Fiber Assembly | Appearance |
|---|---|---|---|---|
| 50(comparison) | 2.0 | 0.19–0.21 | 0–0.20 | unplated areas in lower portion of fiber assembly |
| 150 | 2.0 | 0.20–0.23 | 0.18–0.21 | metallic luster |
| 300 | 0.5 | 0.21–0.23 | 0.20–0.22 | metallic luster |
| 300 | 0.3 (comparison) | 0.21–0.23 | 0.21–0.22 | unplated areas in interior portion of fiber assembly |
| 300 | 2.0 | 0.21–0.22 | 0.19–0.21 | metallic luster |
| 300 | 3.6 | 0.19–0.24 | 0.15–0.22 | metallic luster |
| 300 | 6.0 (comparison) | 0.20–0.23 | 0–0.17 | unplated areas in lower portion of fiber assembly |
| 700(comparison) | 2.0 | 0.22–0.32 | 0.10–0.27 | lightly blackened because of self decomposition of plating solution caused 20 minutes after initiation of plating |
| dipped in plating solution (conventional method) | — | 0.09–0.25 (Outer portion) | 0 (central portion) | heavy black appearance with no metallic luster because of self-decomposition of plating solution caused 8 minutes after initiation of plating |

EXAMPLE 2

0.5 Kg of 6*d* × 51mm of polyvinyl alcohol staple fibers (degree of formalization being 38%), which had been deoiled and activated in the same manner as in Example 1, were electrolessly metal-plated by using a cylinder having 60 spray holes per 100 $m^2$, the holes each having a diameter of 2 mm. The nickel-plating was carried out at 83°C. for 30 minutes under the following conditions: a fiber assembly packing degree of 1.5 $Kg/m^2$ and a plating solution space velocity of 240 $m^3$ of the plating solution per $m^3$ of the fibers to be plated per hour. The plating solution used had the same composition as that of the solution used in Example 1. As a result, there were obtained nickel-plated polyvinyl alcohol staples which were so uniform in plating layer thickness that the thickness of the plating layer was 0.48 – 0.51 $\mu$ in the uppermost portion of the fiber assembly, 0.46 – 0.50 $\mu$ in the interior portion and 0.45 – 0.49 $\mu$ in the lowermost portion.

EXAMPLE 3

0.4 Kg of 1d × 35mm of polyester staple fibers, which had been deoiled in the same manner as in Example 1, were treated at 95°C. for 30 minutes with an aqueous solution containing 20 g/l of sodium hydroxide to etch the fiber surfaces, and they were washed with water. Then, they were subjected to the same activation and electroless nickel-plating treatment under the same conditions as described in Example 2. The thickness of the plating layer in the so obtained nickel-plated polyester fibers was substantially uniform, namely 0.29 – 0.35 $\mu$ in the uppermost portion of the fiber assembly and 0.25 – 0.33 $\mu$ in the lowermost portion, and the plated fibers had an appearance excellent in luster.

EXAMPLE 4

1.0 Kg of 3d × 57mm of polyacrylonitrile staple fibers, which had been deoiled and activated in the same manner as in Example 1, were electrolessly copper-plated at 25°C. for 15 minutes under the following conditions.

1. Composition of Copper-Plating Solution:
   $CuSO_4.5H_2O$: 17.5 g/l
   $KNaC_4H_4O_6.4H_2O$: 85 g/l
   NaOH: 25 g/l
   Mercapto Benzothiazole: 15 mg/l
   HCHO (36%): 25 ml/l
2. Plating Conditions:
   Amount of plating solution: 200 l
   Amount packed of fiber assembly: 1.0 $Kg/m^2$
   Space velocity of plating solution: 300 $m^3$ of plating solution/ $m^3$ of fibers to be plated/ hour The thickness of the plating layer in the so obtained copper-plated polyacrylonitrile fibers was substantially uniform, namely 0.53 – 0.59 $\mu$ in the uppermost portion of the fiber assembly and 0.49 – 0.55 $\mu$ in the lowermost portion, and the plated fibers had an appearance excellent in luster.

EXAMPLE 5

Polyvinyl alcohol staple fibers (6d × 51mm), which had been deoiled and activated in the same manner as in Example 1, were electrolessly cobolt-nickel plated at 85°C. for 20 minutes under the following conditions.

1 Composition of Cobalt-Nickel-Plating Solution:
   $CoSO_4$: 0.08 mole/l
   $NiSO_4$: 0.02 mole/l
   $NaH_2PO_2$: 0.2 mole/l
   $C_6H_5O_7$. $2H_2O$: 0.2 mole/l
2. Plating Conditions:
   Amount of plating solution: 200 l
   Amount packed of fiber assembly: 2.0 $Kg/m^2$
   Sapce velocity of plating solution: 300 $m^3$ of plating solution/ $m^3$ of fibers to be plated/ hour
   PH: 9.0

The thickness of the plating layer in the so obtained cobalt-nickel-plated fiber was substantially uniform, namely 0.26 – 0.31 $\mu$ in the uppermost portion of the fiber assembly and 0.25 – 0.31 $\mu$ in the lowermost portion, and the plated fibers had an appearance excellent in luster.

EXAMPLE 6

Cotton fibers which had been activated in the same manner as in Example 1 were electrolessly nickel-plated at 85°C. for 30 minutes under the following conditions.

1. Composition of Nickel-Plating Solution; same in Example 1
2. Plating Conditions:
   Amount of plating solution: 200 l
   PH: 5.0
   Sapce velocity of plating solution: 300 $m^3$ of plating solution/ $m^3$ of fibers to be plated/ hour
   Amount packed of fiber assembly: 1.0 $Kg/m^2$ The thickness of the plating layer in the so obtained nickel-plated fibers was substantially uniform, namely 0.18 – 0.25 $\mu$ in the uppermost portion of the fiber assembly and 0.17 – 0.22 $\mu$ in the lowermost portion, and the plated fibers had an appearance excellent in luster.

What we claim is:

1. A process for the production of metal plated staple fibers comprising providing said fibers having an areal weight of 0.5 to 5.0 $kg/m^2$, activating said fibers and spraying an electroless metal plating solution onto the activated fibers at a space velocity of 100 to 600 $m^3$ of said solution per $m^3$ of said fibers per hour.

2. A process set forth in claim 1 wherein said areal weight is from 2.0 to 3.5 $kg/m^2$.

3. A process set forth in claim 1 wherein said space velocity is from 150 to 450 $m^3$ of said solution per $m^3$ of said fibers per hour.

4. A process set forth in claim 1 wherein the length of said fibers is 10 to 200 mm.

5. A process set forth in claim 1 wherein said fibers are from 0.1 to 15 denier.

6. A process set forth in claim 1 wherein said fibers are synthetic.

7. A process set forth in claim 1 wherein said metal is selected from the group consisting of Ni, Cu, Co, Cr, Sn and mixtures thereof.

8. A process set forth in claim 1 wherein said solution is sprayed from a cylinder head having spray holes of 2 to 5mm in diameter and 25 to 100 holes per 100$cm^2$ of the surface of the head.

9. A process according to claim 7 wherein the metal is Ni.

10. A process set forth in claim 6 wherein the synthetic fibers are obtained by a wet or dry spinning process.

11. A process set forth in claim 10 wherein the fiber is of polyvinyl alcohol.

12. A process set forth in claim 10 wherein the fiber is of polyacrylonitrile.

* * * * *